US007776172B2

(12) United States Patent
Tonohara

(10) Patent No.: US 7,776,172 B2
(45) Date of Patent: Aug. 17, 2010

(54) WEB JOINING APPARATUS AND METHOD

(75) Inventor: Koji Tonohara, Minami-Ashigara (JP)

(73) Assignee: FUJIFILM Corporation, Tokyo (JP)

( * ) Notice: Subject to any disclaimer, the term of this patent is extended or adjusted under 35 U.S.C. 154(b) by 993 days.

(21) Appl. No.: 11/526,593

(22) Filed: Sep. 26, 2006

(65) Prior Publication Data

US 2007/0204950 A1 Sep. 6, 2007

(30) Foreign Application Priority Data

Sep. 29, 2005 (JP) ..... 2005-285111

(51) Int. Cl.
*B65H 21/00* (2006.01)

(52) U.S. Cl. ..... 156/159; 156/504; 156/505; 242/553; 242/555.3; 242/555.5; 242/555.6; 242/556.1

(58) Field of Classification Search ..... 156/157, 156/159, 502, 504, 505; 242/551, 553, 554.2, 242/555, 555.3, 555.5, 555.6, 556.1
See application file for complete search history.

(56) References Cited

U.S. PATENT DOCUMENTS 3,717,057 A * 2/1973 Takimoto ..... 83/98
3,939,031 A * 2/1976 Takimoto ..... 156/505
4,234,365 A * 11/1980 Shimizu et al. ..... 156/64
4,315,794 A * 2/1982 Palmieri ..... 156/504
4,492,609 A * 1/1985 Blom ..... 156/507
6,881,289 B2 * 4/2005 Borderi et al. ..... 156/159

FOREIGN PATENT DOCUMENTS

JP 53-114902 A 10/1978
JP 54-91676 A 7/1979
JP 59-149258 A 8/1984

OTHER PUBLICATIONS

Japanese Office Action dated Sep. 30, 2009 in corresponding Japanese Patent Application No. 2005-285111.

* cited by examiner

*Primary Examiner*—Mark A Osele
(74) *Attorney, Agent, or Firm*—Sughrue Mion, PLLC

(57) ABSTRACT

A web joining apparatus and related method. The apparatus includes a turret arm which supports an old roll and a new roll around which band-state flexible support bodies are wound, a front pasting drum including a holding device holding the tip end of the band-state flexible support body of the new roll and a cutting drum provided with a cutting member with substantially the same length as the width of the band-state flexible support body. A projection amount is set so that only a single sheet of the band-state flexible support body can be cut off. The flexible support body of the old roll is cut off and the tail end of the flexible support body of the old roll and the tip end of the flexible support body of the new roll are joined as the band-state flexible support body is conveyed.

12 Claims, 11 Drawing Sheets

WEB JOINING APPARATUS AND METHOD

BACKGROUND OF THE INVENTION

1. Field of the Invention

The present invention relates to a web joining apparatus and a method and particularly to a web joining apparatus and a method for joining a thin-plate band-state material such as plastic, paper, metal foil, etc. (hereinafter referred to as "web") in the state where ends of a new and an old rolls are overlapped with each other.

2. Description of the Related Art

A conventional web joining apparatus in general is an apparatus of a so-called face-to-face joining type by which a tail end of an old web and a tip end of a new web is abutted to each other at joining and joined in that state by pasting them through extension of a joining tape to the both (See Japanese Examined Application Publication No. 48-38461, for example). This type of apparatus has a long history of operation and is still in use after repeated improvements (See Japanese Patent Application Laid-Open No. 6-171806, for example).

The face-to-face web joining apparatus described in this Japanese Patent Application Laid-Open No. 6-171806 is a three-drum type apparatus comprising a cutting drum provided with a cutting blade and a member for withdrawing a web tip end of a new roll and capable of rotation at the same speed as a conveying speed of the web, a cutting/joining drum capable of rotation at the same speed as the conveying speed of the web, and a joining drum detachably holding a joining tape and capable of rotation at the same speed as the conveying speed of the web, wherein the webs are cut off and joined while the tail end of the old roll and the tip end of the new roll are held at each of the drums so that the webs can be cut and joined at a high speed.

However, in the conventional face-to-face web joining apparatus, there is a problem that it is not suitable for a process requiring high cleanliness (degree of cleanness) (such as a manufacturing process of a functional film used in a liquid crystal display device).

Specifically, in the apparatus of the above Japanese Patent Application Laid-Open No. 6-171806, for example, a guide member with a triangular section for guiding the web at joining so that it does not deviate from a web conveying path is provided in a space portion in the substantially triangular shape surrounded by rotating outer circumferences of the cutting drum, the cutting/joining drum and the joining drum. But this guide member is rubbed by the web, which often generates contamination such as dusts.

Moreover, the old roll web is rubbed by the new roll web, which generates contamination such as dusts in many cases.

However, if a measure is to be taken against these problems, it is difficult to exclude the guide member and the like from the viewpoint of the principle of face-to-face abutting of the webs, and it is also difficult to employ a construction to prevent rubbing between the old roll web and the new roll web, for which improvement by other devices has been in demand.

The present invention was made in view of these circumstances, and its object is to provide a web joining apparatus and a method which can improve joining accuracy without generating contamination such as dusts so as to be applied to a process requiring high cleanliness (degree of cleanness) and can improve web quality.

SUMMARY OF THE INVENTION

The present invention provides, in order to achieve the above object, a web joining method in which, while a band-state flexible support body wound around an old roll is made to run, the band-state flexible support body of the old roll is cut off and the vicinity of a tail end of the band-state flexible support body of the old roll and a tip end of a band-state flexible support body wound around a new roll are joined to each other, comprising the steps of:

holding the tip end of the band-state flexible support body of the new roll at a front side drum;

holding a back pasting joining tape at a back pasting drum;

overlapping the tail end of the band-state flexible support body of the old roll and the tip end of the band-state flexible support body of the new roll with each other while the front-side drum is rotated at the same speed as a conveying speed of the band-state flexible support body;

cutting off the band-state flexible support body of the old roll after overlapping;

discarding an upstream portion in the conveying direction of the cut-off band-state flexible support body of the old roll; and joining through the back pasting joining tape a downstream portion in the conveying direction of the band-state flexible support body of the cut-off old roll to the tip end of the band-state flexible support body of the new roll while the back pasting drum is rotated at the same speed as the conveying speed of the band-state flexible support body.

According to the present invention, differently from the so-called face-to-face joining method in which the tail end of the old web and the tip end of the new web are abutted to each other at web joining and they are joined by pasting through extension of a joining tape over the both, a so-called overlapping joining method is employed in which the tip end of the new web held on the front-side drum is overlapped with the vicinity of the tail end of the old web on the front-side drum and then, only the old web is cut off after overlapping and the upstream portion of the old web is fed backward to be discarded substantially at the same time and after that, the tail end of the old web and the tip end of the new web are joined to each other through a back pasting joining tape.

According to such an overlapping joining method, a guide member is not needed for guiding the web at the joining to prevent the web from deviating from the conveying path, and such nonconformity is not caused that the guide member is rubbed with the web to generate contamination such as dusts.

Also, since the upstream portion of the old web is fed backward to be discarded substantially at the same time with the cutting of the old web, nonconformity of generation of contamination such as dusts due to rubbing between the old web and the new web is not caused, either.

Therefore, contamination such as dusts is not caused so as to be applied to a process requiring high cleanliness (degree of cleanness), the joining accuracy can be improved, and the web quality can be improved.

Moreover, the present invention provides a web joining apparatus, comprising:

a turret arm which supports an old roll and a new roll around which band-state flexible support bodies are wound capable of drawing and is rotatable per predetermined angle;

a front pasting drum provided with a holding device which holds the tip end of the band-state flexible support body of the new roll to which a double-sided joining tape is pasted on the back side of the tip end and capable of rotation at the same speed as the conveying speed of the band-state flexible support body at the joining of the band-state flexible support body; and a cutting drum provided with a cutting member with substantially the same length as the width of the band-state flexible support body, the cutting member being provided on circumferential surface and in which a projection amount from the circumferential surface is set so that only a single sheet of the band-state flexible support body can be cut off, the cutting drum being capable of rotation at the same speed as the conveying speed of the band-state flexible support body at the cutting of the band-state flexible support body, wherein the band-state flexible support body of the old roll is cut off and the tail end of the band-state flexible support body of the old roll and the tip end of the band-state flexible support body of the new roll are joined to each other while the band-state flexible support body is being conveyed.

According to the present invention, differently from the so-called face-to-face joining method in which the tail end of the old web and the tip end of the new web are abutted to each other at web joining and they are joined by pasting through extension of a joining tape over the both, a so-called overlapping joining method is employed in which the tip end of the new web and the vicinity of the tail end of the old web to which the double-sided joining tape is pasted in advance are joined to each other through the double-sided joining tape and only the old web after joining is cut off substantially at the same time.

According to such an overlapping joining method, various effects as above can be obtained. Particularly, in this apparatus, differently from the conventional three-drum (or four-drum) method, a two-drum method having a front pasting drum and a cutting drum can be employed, which can simplify the apparatus construction.

Moreover, the present invention provides a web joining method in which, while a band-state flexible support body wound around an old roll is made to run, the band-state flexible support body of the old roll is cut off and the vicinity of a tail end of the band-state flexible support body of the old roll and a tip end of a band-state flexible support body wound around a new roll are joined to each other, comprising the steps of:

holding at the front pasting drum the tip end of the band-state flexible support body of the new roll to which a front pasting joining tape is pasted on the front side of the tip end;

holding a back pasting joining tape at a back pasting drum;

joining the tail end of the band-state flexible support body of the old roll and the tip end of the band-state flexible support body of the new roll to each other through the front pasting joining tape while the front pasting drum is rotated at the same speed as the conveying speed of the band-state flexible support body;

cutting off the band-state flexible support body of the old roll after joining;

discarding an upstream portion in the conveying direction of the cut-off band-state flexible support body of the old roll; and joining a downstream portion in the conveying direction of the cut-off band-state flexible support body of the old roll and the tip end of the band-state flexible support body of the new roll to each other through the back pasting joining tape while the back pasting drum is rotated at the same speed as the conveying speed of the band-state flexible support body.

Also, for that purpose, a web joining apparatus is provided comprising:

a turret arm which supports an old roll and a new roll around which band-state flexible support bodies are wound capable of drawing and is rotatable per predetermined angle;

a front pasting drum provided with a holding device which holds the tip end of the band-state flexible support body of the new roll to which a front pasting joining tape is pasted on the front side of the tip end and capable of rotation at the same speed as the conveying speed of the band-state flexible support body at the joining of the band-state flexible support body;

a back pasting drum provided with a holding device which holds the back pasting joining tape capable of peeling and capable of rotation at the same speed as the conveying speed of the band-state flexible support body at the joining of the band-state flexible support body; and a cutting drum provided with a cutting member with substantially the same length as the width of the band-state flexible support body, the cutting member being provided on circumferential surface and in which a projection amount from the circumferential surface is set so that only a single sheet of the band-state flexible support body can be cut off, the cutting drum being capable of rotation at the same speed as the conveying speed of the band-state flexible support body at the cutting of the band-state flexible support body, wherein the band-state flexible support body of the old roll is cut off and the tail end of the band-state flexible support body of the old roll and the tip end of the band-state flexible support body of the new roll are joined to each other while the band-state flexible support body is being conveyed.

In the web joining apparatus of the present invention, it is preferable to provide a backward feeding device which withdraws the band-state flexible support body of the old roll in the direction opposite to the conveying direction so that the band-state flexible support body is withdrawn in the direction opposite to the conveying direction substantially at the same time as cutting-off of the band-state flexible support body of the old roll.

According to the present invention, differently from the so-called face to face joining method in which the tail end of the old web and the tip end of the new web are abutted to each other at web joining and they are joined by pasting through extension of a joining tape over the both, a so-called overlapping joining method is employed in which the tip end of the new web to which the front pasting joining tape is pasted in advance and the vicinity of the tail end of the old web are joined to each other through the front pasting joining tape and then, only the old web is cut off after joining, and the upstream portion of the old web is fed backward and discarded substantially at the same time and after that, the joined opposite surfaces are joined through the back pasting joining tape.

According to such an overlapping joining method, a guide member is not needed for guiding the web at the joining to prevent the web from deviating from the conveying path, and such nonconformity is not caused that the guide member is rubbed with the web to generate contamination such as dusts.

Also, since the upstream portion of the old web is fed backward to be discarded substantially at the same time with the cutting-off of the old web, nonconformity of generation of contamination such as dusts due to rubbing between the old web and the new web is not caused, either.

Therefore, contamination such as dusts is not caused so as to be applied to a process requiring high cleanliness (degree of cleanness), the joining accuracy can be improved, and the web quality can be improved.

In the present invention, it is preferable to provide steps of:

pasting a double-sided joining tape on the back side of the tip end of the band-state flexible support body of the new roll; and joining the vicinity of the tail end of the band-state flexible support body of the old roll and the tip end of the band-state flexible support body of the new roll to each other through the double-sided joining tape at joining of the vicinity of the tail end of the band-state flexible support body of the old roll and the tip end of the band-state flexible support body of the new roll to each other through the front pasting joining tape.

In this way, by joining the vicinity of the tail end of an old web and the tip end of a new web to each other through the double-sided joining tape before joining through the back pasting joining tape, the overlapping joining can be performed more surely.

Moreover, the present invention provides, in order to achieve the purpose, a web joining method in which, while a band-state flexible support body wound around an old roll is made to run, the band-state flexible support body of the old roll is cut off and the vicinity of a tail end of the band-state flexible support body of the old roll and a tip end of a band-state flexible support body wound around a new roll are joined to each other, comprising the steps of:

holding at the front pasting drum the tip end of the band-state flexible support body of the new roll to which a front pasting joining tape is pasted on the front side of the tip end;

joining the tail end of the band-state flexible support body of the old roll and the tip end of the band-state flexible support body of the new roll to each other through the front pasting joining tape while the front pasting drum is rotated at the same speed as the conveying speed of the band-state flexible support body;

cutting off the band-state flexible support body of the old roll after joining; and discarding an upstream portion in the conveying direction of the cut-off band-state flexible support body of the old roll.

According to the present invention, since a back pasting drum as in the above-mentioned joining method and apparatus is not needed but the webs can be joined in the 2-drum construction with the front pasting drum and the cutting drum, the apparatus construction can be advantageously simplified.

Moreover, the present invention provides, in order to achieve the purpose, a web joining method in which, while a band-state flexible support body wound around an old roll is made to run, the band-state flexible support body of the old roll is cut off and the vicinity of a tail end of the band-state flexible support body of the old roll and a tip end of a band-state flexible support body wound around a new roll are joined to each other, comprising the steps of:

holding at the front pasting drum the tip end of the band-state flexible support body of the new roll to which a double-sided joining tape is pasted on the back side of the tip end;

joining the tail end of the band-state flexible support body of the old roll and the tip end of the band-state flexible support body of the new roll to each other through the double-sided joining tape while the front pasting drum is rotated at the same speed as the conveying speed of the band-state flexible support body;

cutting off the band-state flexible support body of the old roll after joining; and discarding an upstream portion in the conveying direction of the cut-off band-state flexible support body of the old roll.

According to the present invention, since a back pasting drum as in the above-mentioned joining method and apparatus is not needed but the webs can be joined in the 2-drum construction with the front pasting drum and the cutting drum, the apparatus construction can be advantageously simplified.

As mentioned above, according to the present invention, since contamination such as dusts is not caused, the invention can be applied to a process requiring high cleanliness (degree of cleanness), the joining accuracy can be improved and the web quality can be improved.

DETAILED DESCRIPTION OF THE PREFERRED EMBODIMENTS

Figure 1:
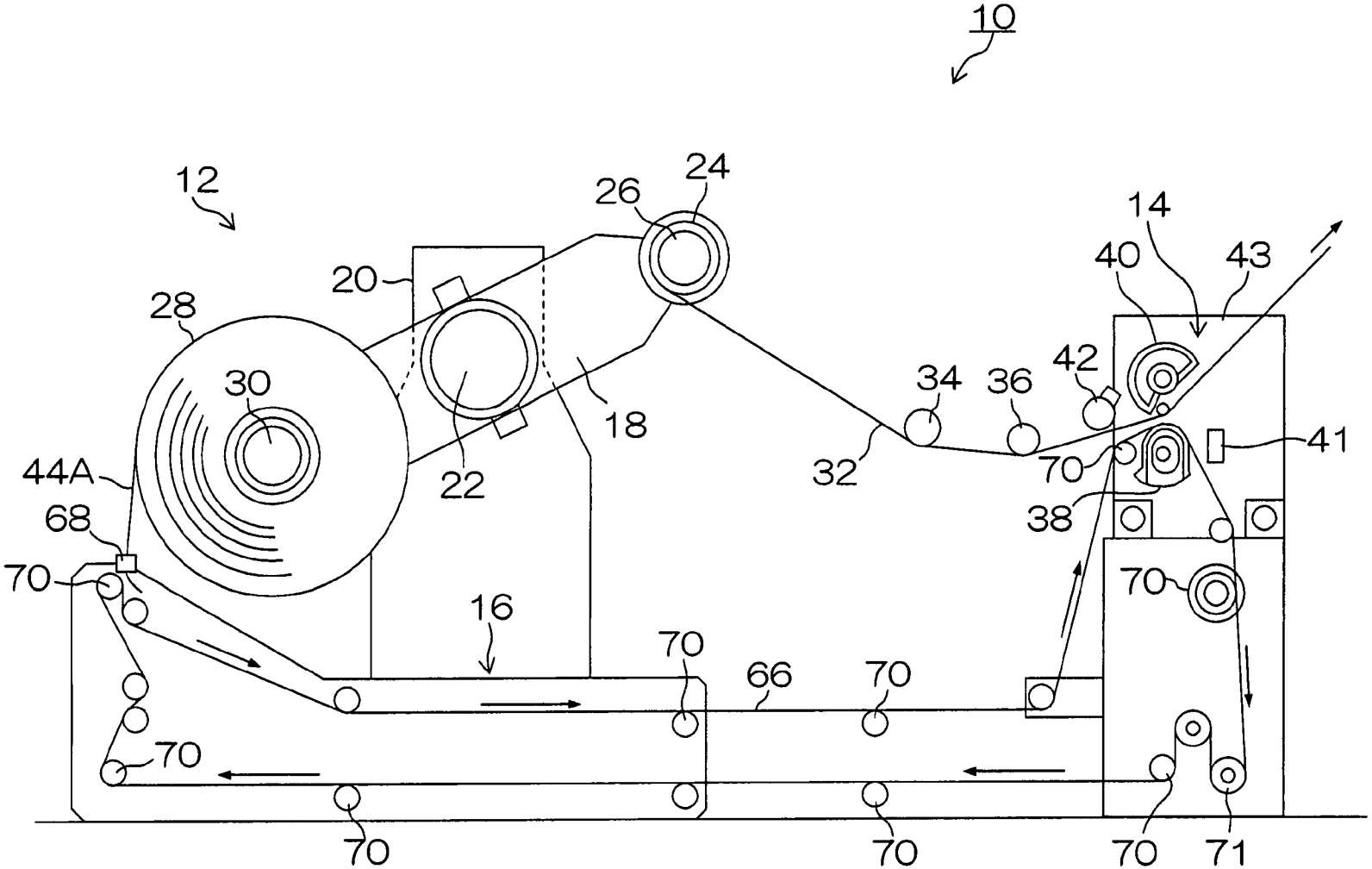
FIG. 1 is a block diagram of a web joining apparatus of the present invention.

A preferred embodiment (first embodiment) of a web joining apparatus and a method according to the present invention will be described below in detail referring to the attached drawings. FIG. 1 is an entire diagram of a web joining apparatus 10 according to the embodiment of the present invention. As shown in FIG. 1, the web joining apparatus 10 comprises a turret device 12 as a turret device, a web joining unit 14 as a joining device, and a web conveying device 16 as a conveying device.

The turret device 12 has a turret arm 18, and this turret arm 18 is provided rotatably at a support column 20 with a shaft 22 as the fulcrum. At one end of this turret arm 18, an old roll 24 in which rewinding of the web is to end is rotatably supported by a shaft 26, while at the other end, a new roll 28 in which drawing of the web is to start is rotatably supported by a shaft 30. A web 32 is drawn from the old roll 24. This web 32 is in rotating contact with guide rollers 34, 36 and guided to the web joining unit 14.

The shaft 26 and the shaft 30 of the turret device 12 are provided with a clutch device (not shown) so that they can be instantaneously switched to the direction opposite to the web drawing direction.

Figure 2:
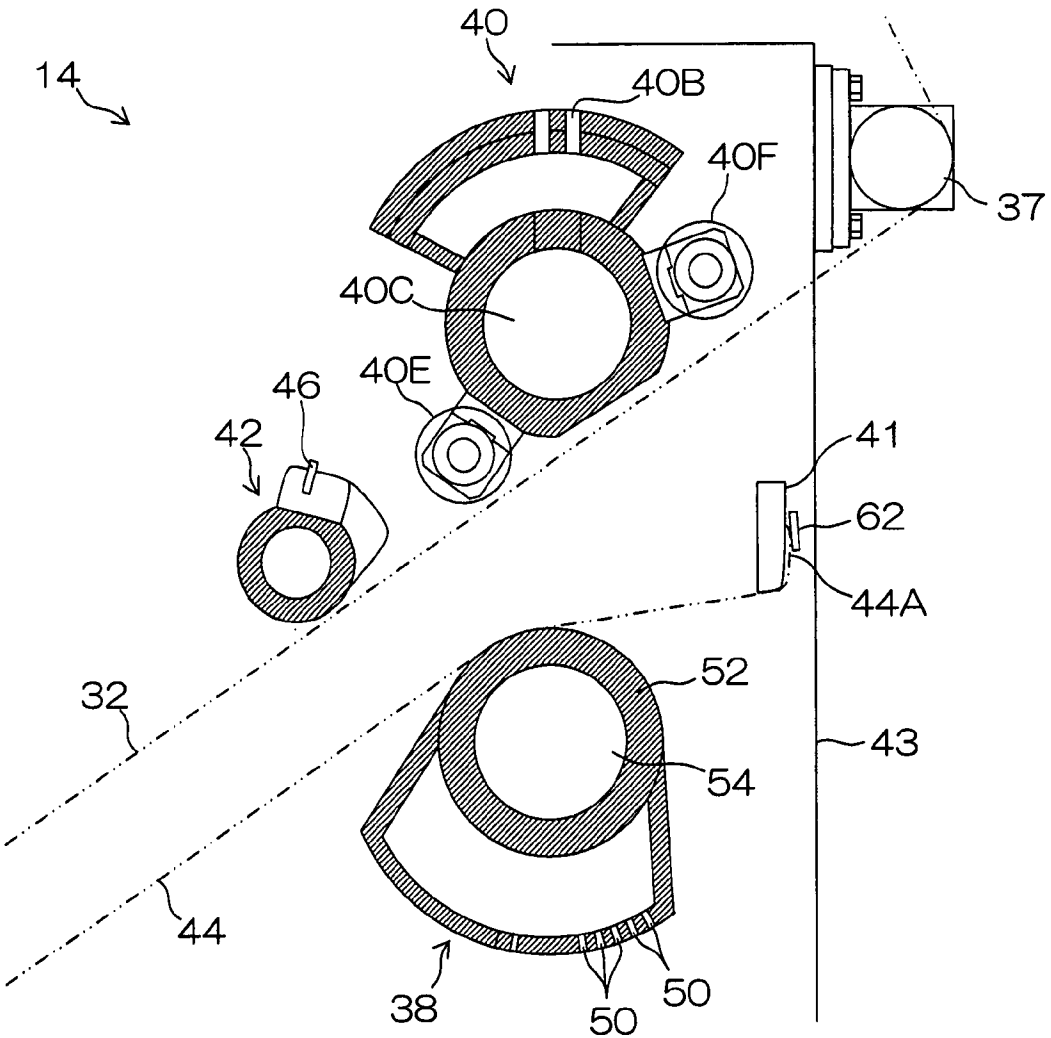
FIG. 2 is a structural diagram of a web joining unit.

The web joining unit 14 comprises, as shown in FIG. 2, a front pasting drum 38, a back pasting drum 40 and a cutting drum 42, and each of them is installed at a machine frame 43. These drums 38, 40, 42 are rotated in synchronization by power from a driving motor, not shown. The web 32 is inserted between the front pasting drum 38 and the back pasting drum 40 as well as the cutting drum 42 and wound by a winding device, not shown.

Figure 3B:
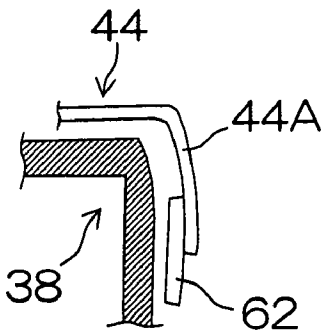
FIGS. 3A and 3B are operation explanatory diagrams of the web joining unit.

The tip end of a web 44 from the new roll 28 is conveyed by the web conveying device 16 (See FIG. 1), which will be described later, to the position of the web joining unit 14 from the position of the new roll 28, and then, it is attracted by an attracting plate 41 as shown in FIG. 2 and waits ready for joining. The attracting plate 41 is movable to be moved as shown by an arrow 41A in FIG. 3, which will be described later, so that the tip end of the web 44 can be supplied to the front pasting drum 38.

To the tip end of the web 44 attracted by the attracting plate 41, a front pasting joining tape 62 is supplied and pasted by a front pasting tape supply device, not shown.

In FIG. 2, a cutter 46 is mounted at the cutting drum 42. This cutter 46 is to cut of only the web 32 in the state where the web 32 is overlapped with the web 44 wound and held by the front pasting drum 38 as shown in FIG. 6, which will be described later. Therefore, a projection amount of the tip end of the cutter 46 from the cutting drum 42 is preferably set substantially equal to the thickness of the web 32.

On the flat potion on the surface of the front pasting drum 38, vent holes 50 are formed, and these vent holes 50 communicate with a vent hole 54 formed at a rotary hollow shaft 52. To the rotary hollow shaft 52, an air intake device and an air supply device, not shown, are connected. When the air intake device is driven, the vicinity of the tip end of the web 44 is attracted and held by the vent holes 50, as shown in FIG. 4, which will be described later, while when the air supply device is driven, cutting chips of the web 44 are removed from the front pasting drum 38 at the position shown in FIG. 9, which will be described later.

The back pasting drum 40 has an attracting disk 40B for detachably attracting the back face of the back pasting joining tape 47 substantially at the center of its outer circumference part and is linked to an attracting device, not shown, through a hollow shaft portion 40C. Also, guide rollers 40E, 40F are mounted to the back pasting drum 40 for supporting the web (old web 32) between the old roll 28 and a pass roller 37.

This web joining unit 14 is controlled to be driven when the tail end of the web 32 from the old roll 24 comes close to the web joining unit 14. The details will be described later.

The above-mentioned web conveying device 16 is comprised by, as shown in FIG. 1, a revolving device of endless chains 66, 66 (one of chains is not shown) as a moving device and a holding member 68 connected to these chains 66, 66. The chains 66, 66 are placed with an interval wider than the width of the web 44 and revolved/moved in the direction shown by an arrow in the figure through a plurality of sprockets 70 within a range from a lower position of the new roll 28 to a joining position of the joining unit 14. Reference numeral 71 designates a driving sprocket for the chain 66, and this sprocket 71 is mounted to the machine frame 43.

The holding member 68 is comprised by two lengthy plates. These plates are both formed wider than the width of the web 32 so that the entire width of the tip end of the web 32 can be held over the entire area.

Next, the web joining method by the web joining device 10 constructed as above will be sequentially described referring to FIGS. 1 to 9.

First, in FIG. 1, the chains 66, 66 of the conveying device 16 are revolved/moved to position the holding member 68 at the lower position of the new roll 28 as shown. Then, a tip end 44A of the web 44 of the new roll 28 is drawn from the new roll 28 by a predetermined amount. Then, the entire width of the web 44 is held by the two plates of the holding member 68 over the entire area. By this, conveying preparation work of the web 44 is completed.

Then, the chains 66, 66 are revolved/moved to move the holding member 68. By this, the web 44 is drawn from the new roll 28, and when the tip end 44A of the web 44 is positioned at the joining position of the joining unit 14, that is, the position shown in FIG. 2, the movement is stopped. And the tip end 44A of the web 44 is attracted by the attracting plate 41.

Then, at the position shown in FIG. 2, the front pasting joining tape 62 is supplied and pasted by a front pasting tape supply device, not shown, to the tip end 44A of the web 44 attracted by the attracting plate 41. At this time, supply is performed so that the lower half of the entire width (vertical width) of the front pasting joining tape 62 shown in the figure is pasted to the tip end 44A of the web 44, while the upper half is left free (not pasted).

Figure 3A:
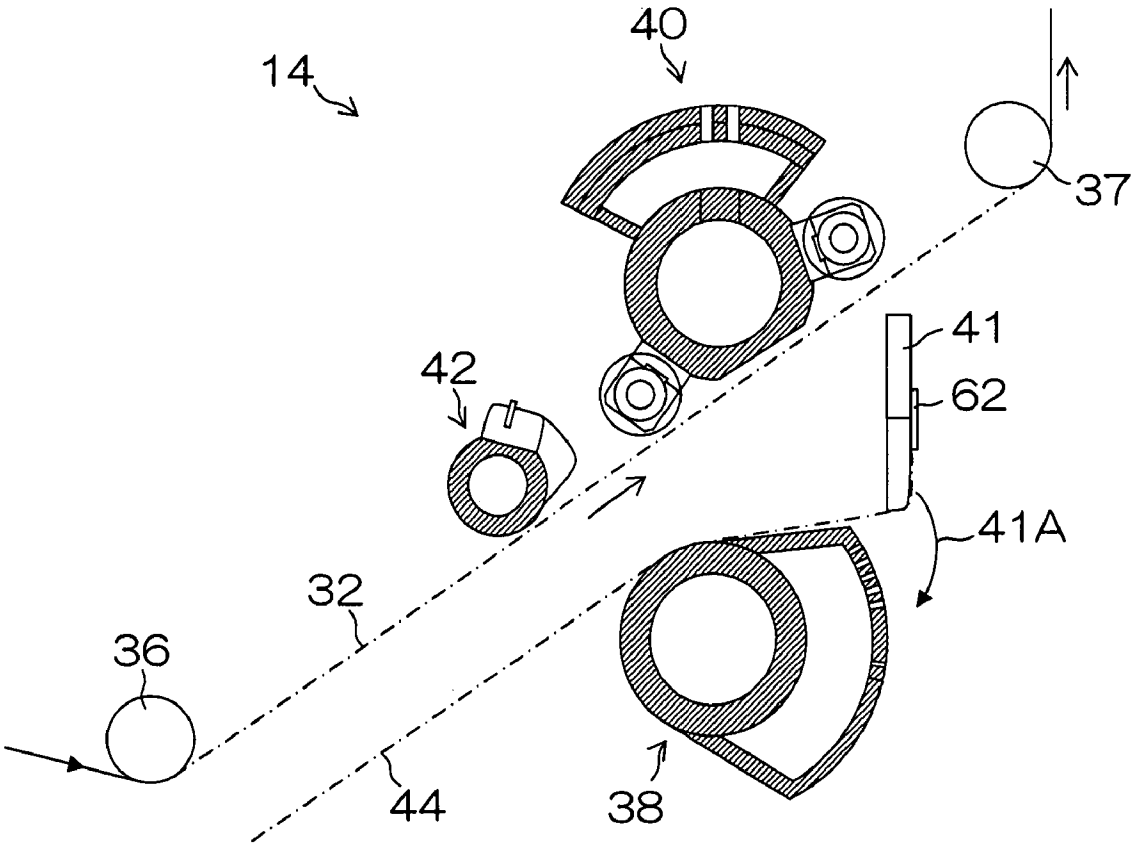

Then, as shown in FIG. 3A, the front pasting drum 38 is rotationally moved in the counterclockwise direction by 90 degrees, the attracting plate 41 is moved as shown by an arrow 41A, and the tip end 44A of the web 44 is supplied to the front pasting drum 38. At the same time, the vent holes 50 (See FIG. 2) are made to communicate with the air intake device, not shown, by which the web 44 to which the front pasting joining tape 62 is pasted at the tip end 44A is attracted and held as shown in the partial enlarged diagram in FIG. 3B.

Figure 4B:
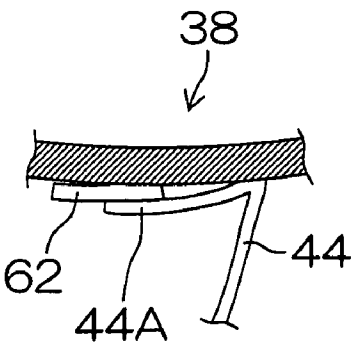
FIGS. 4A and 4B are operation explanatory diagrams of the web joining unit.
Figure 4A:
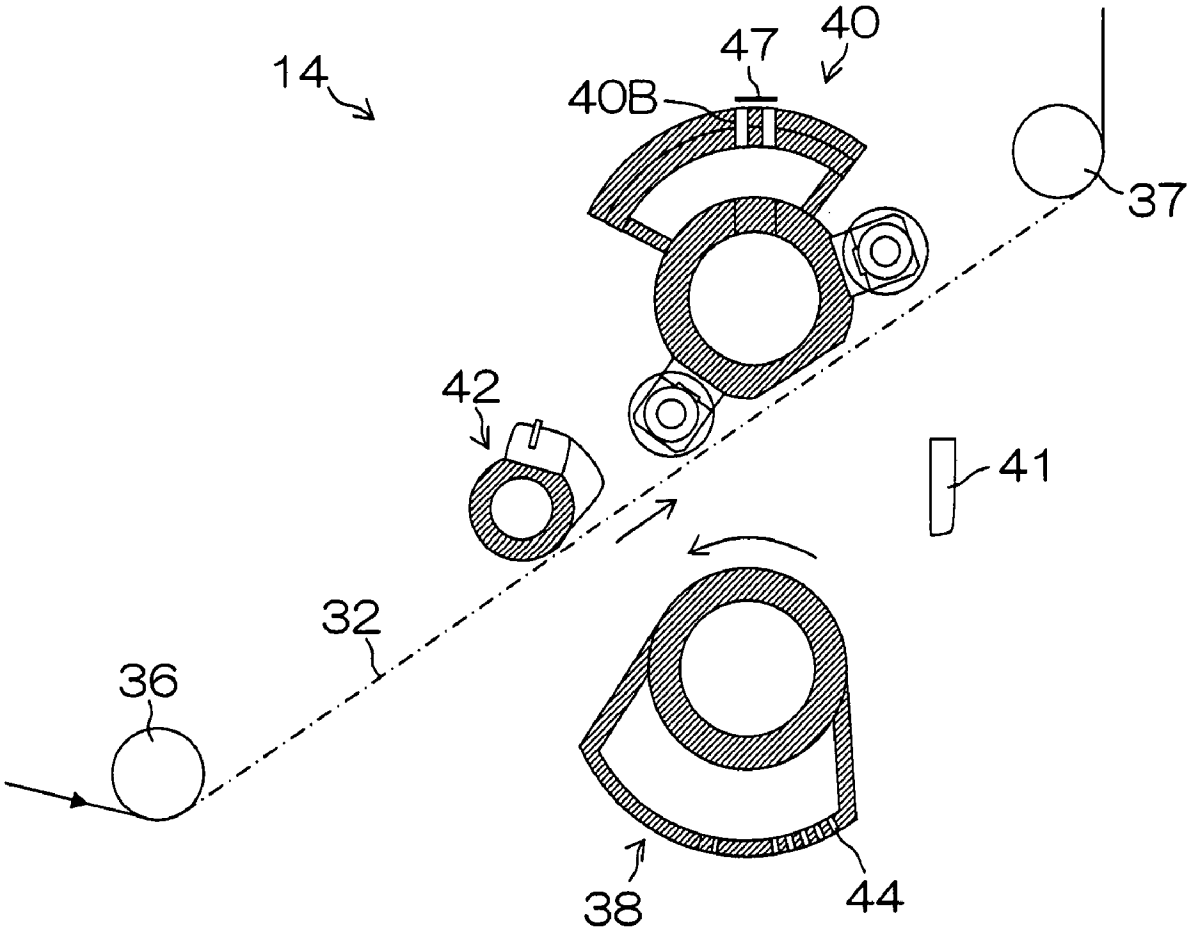

Then, as shown in FIG. 4A, the front pasting drum 38 is rotationally moved in the counterclockwise direction by 270 degrees and kept stationary in that state. FIG. 4B is the partial enlarged diagram showing the tip end 44A of the web 44 in this state.

Also, as shown in FIG. 4A, the back pasting joining tape 47 is supplied by a back pasting tape supply device, not shown, to the position of the attracting disk 40B of the back pasting drum 40. At this time, the supply is performed so that the adhesive surface of the back pasting joining tape 47 comes to the outside (the side opposite to the surface in contact with the back pasting drum 40). And by making the attracting disk 40B communicate with the attracting device, not shown, the back pasting joining tape 47 is attracted and held by the attracting disk 40B.

Figure 5:
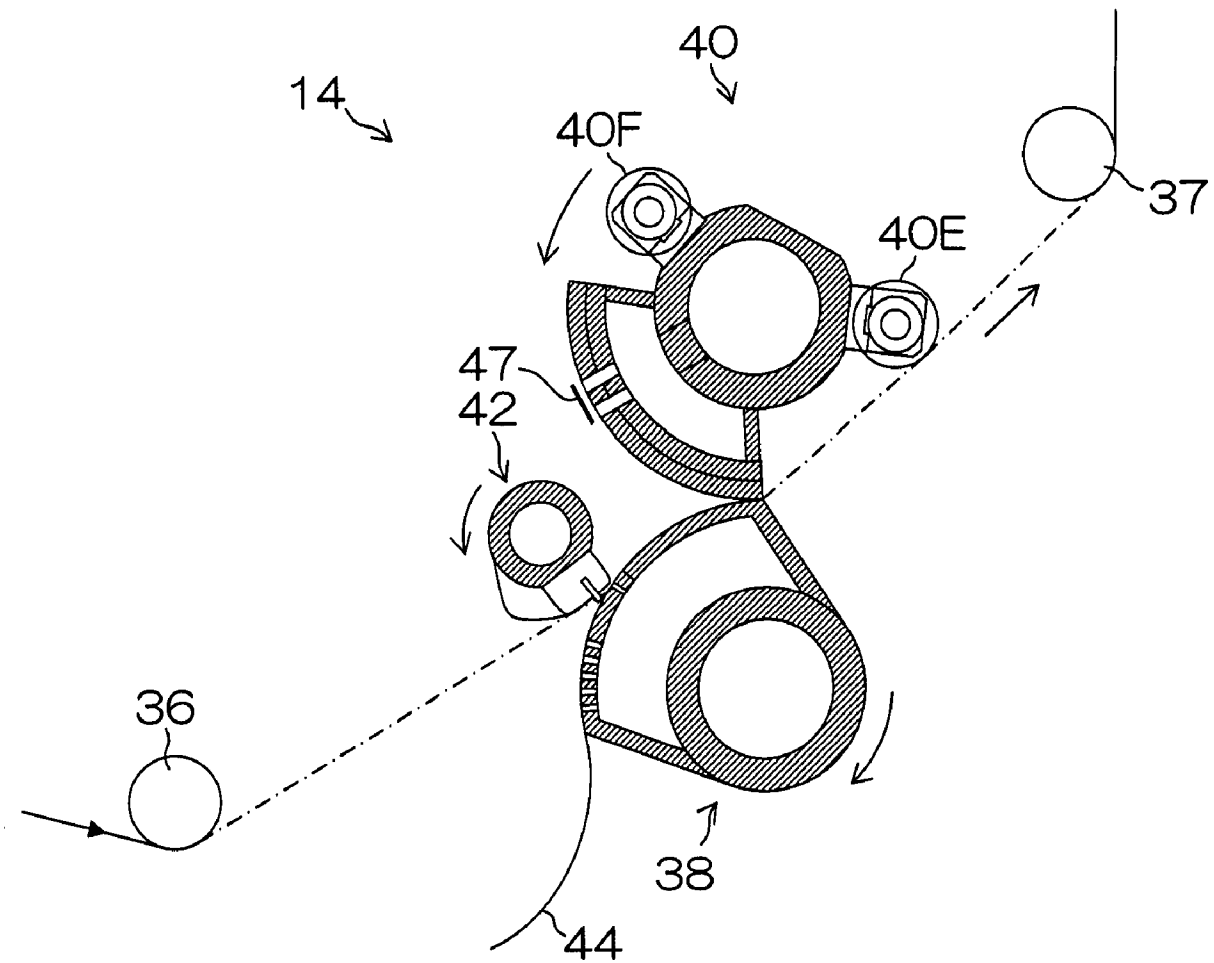
FIG. 5 is an operation explanatory diagram of the web joining unit.

Then, the front pasting drum 38 is rotationally moved in the direction opposite to the arrow direction shown in FIG. 4 (the clockwise direction), and the back pasting drum 40 and the cutting drum 42 are rotationally moved in the arrow direction (counterclockwise direction) in synchronization with that. The circumferential velocity of these drums 38, 40, 42 is set up so as to become the same as the conveying speed of the web 32 at the time of joining. FIG. 5 shows the state where this rotational moving operation progresses.

Figure 6B:
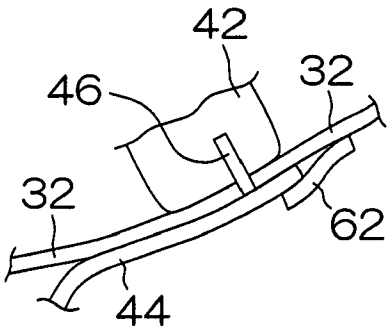
FIGS. 6A and 6B are operation explanatory diagrams of the web joining unit.
Figure 6A:
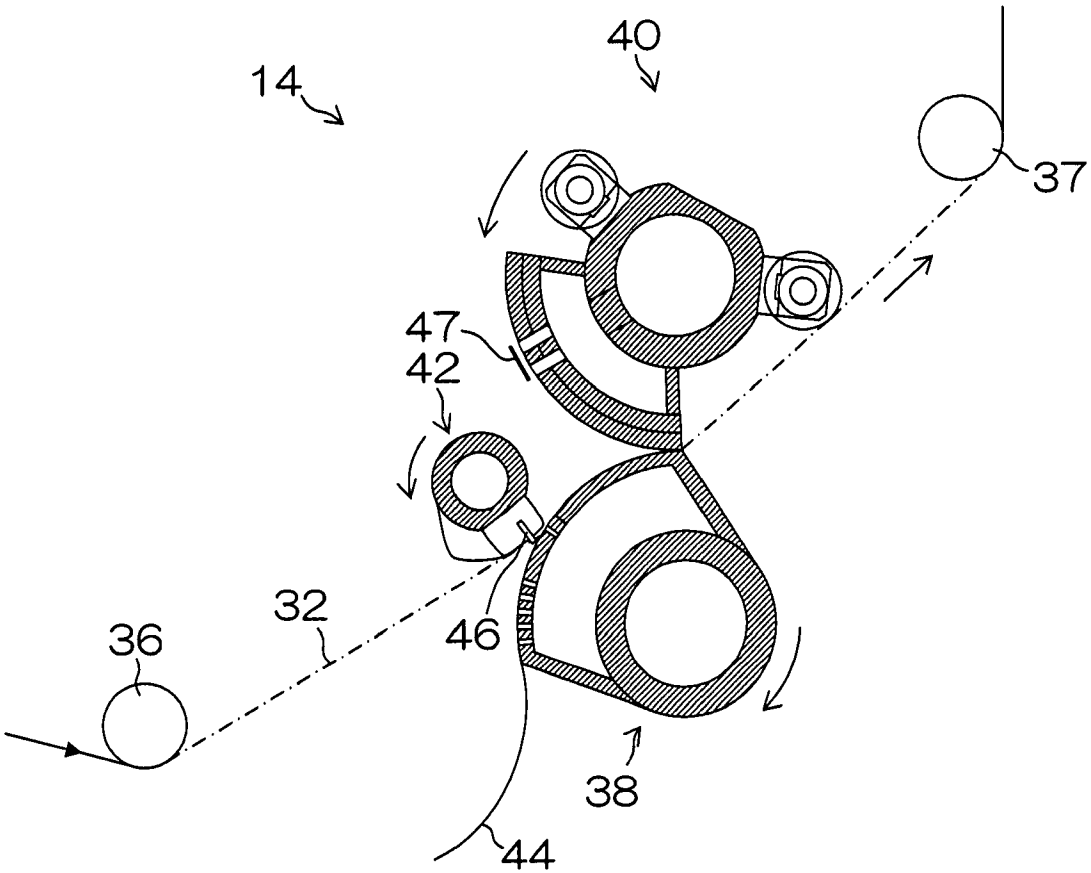

When the respective drums 38, 40, 42 are further moved rotationally, the state shown in FIG. 6A is brought about. In this state, the cutter 46 of the cutting drum 42 cuts off only the web 32 while the web 32 is overlapped over the web 44 wound and held around the front pasting drum 38. The enlarged diagram of this state is shown in FIG. 6B.

In FIG. 6B, on the downstream side (right side) of the cut-off part, the front pasting joining tape 62 is pasted to the web 32, and the web 32 and the web 44 are in the overlapping joined state on one side (front side).

Figure 7B:
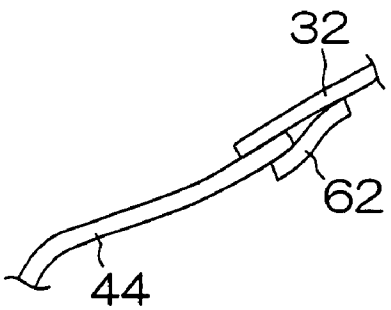
FIGS. 7A and 7B are operation explanatory diagrams of the web joining unit.
Figure 7A:
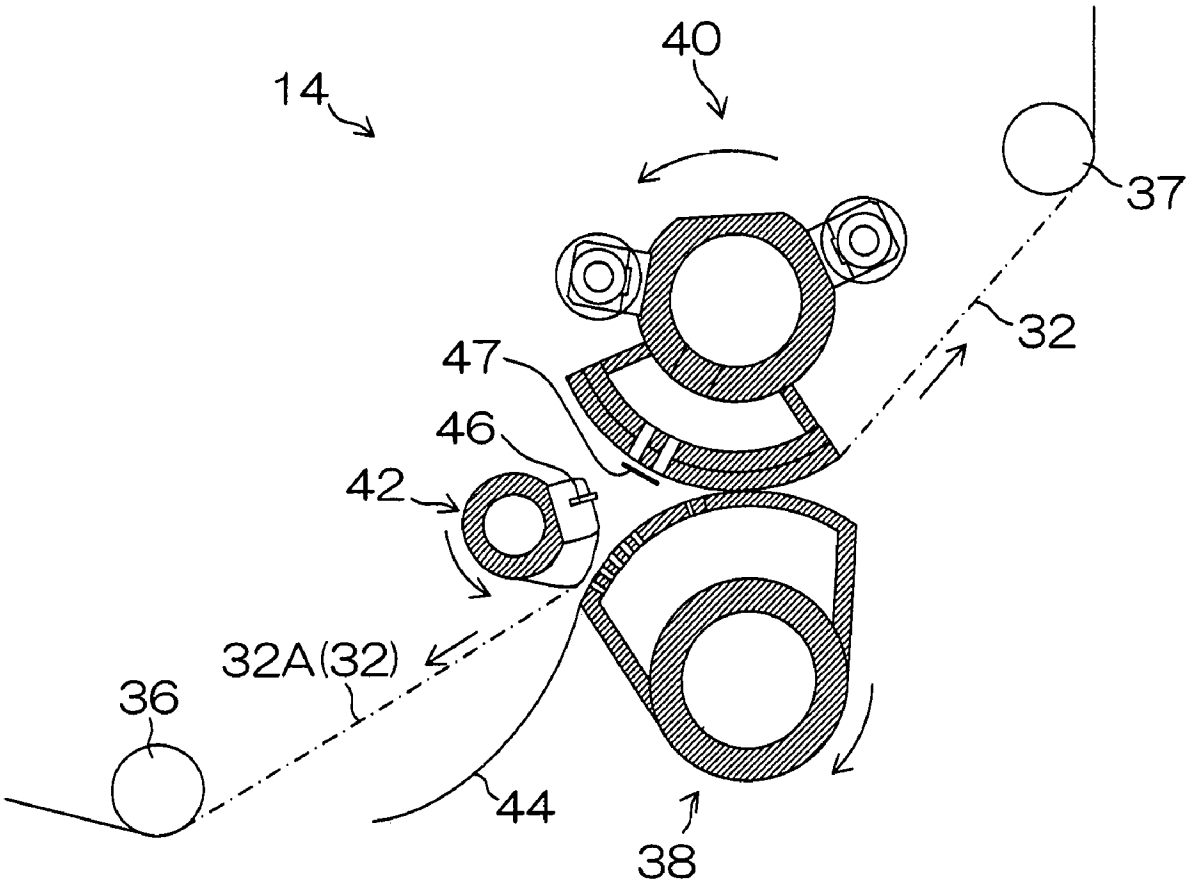

By further rotationally moving the respective drums 38, 40, 42 and instantaneously rotating backward the shaft 26 of the turret device 12 in FIG. 1 through switching of the clutch device (not shown), the left side part (cutting chips 32A of the web 32) of the cut-off web 32 is rewound in the arrow direction and removed from the web joining unit 14 as shown in FIG. 7A. The enlarged diagram of the overlapping joined part in this state is shown in FIG. 7B.

Figure 8B:
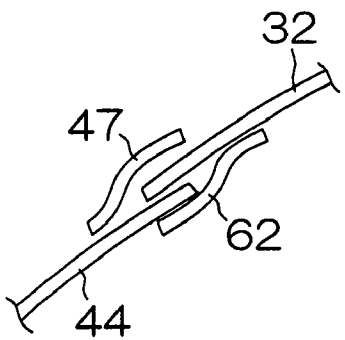
FIGS. 8A and 8B are operation explanatory diagrams of the web joining unit.
Figure 8A:
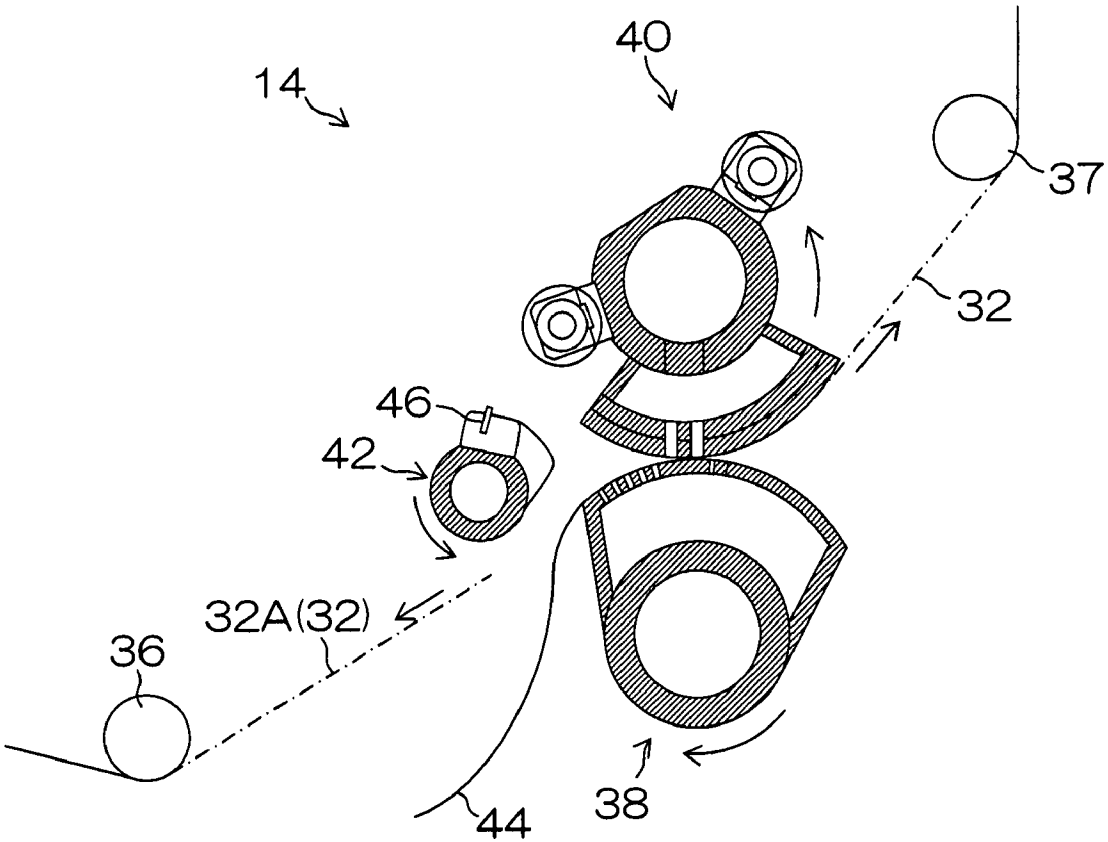

As shown in FIG. 8A, when the respective drums 38, 40, 42 are further rotationally moved, the back pasting joining tape 47 attracted and held by the attracting disk 40B of the back pasting drum 40 is pasted while extending over the overlapping joined part between the web 32 and the web 44. The enlarged diagram of the overlapping joined part in this state is shown in FIG. 8B. That is, the overlapping joined part of the web 32 and the web 44 is joined through the front pasting joining tape 62 and the back pasting joining tape 47 from both sides of front and back.

When the respective drums 38, 40, 42 are further rotationally moved, the respective drums 38, 40, 42 are moved, and at the same time, in the turret device 12 in FIG. 1, the shaft 30 of the new roll 28 is rotated/driven, the drawing of the web 44 is started and the web 44 is conveyed in the arrow direction.

When the respective drums 38, 40, 42 are further rotationally moved, the respective drums 38, 40, 42 are moved, and the winding state of the web 44 around the front pasting drum 38 is released.

Figure 9:
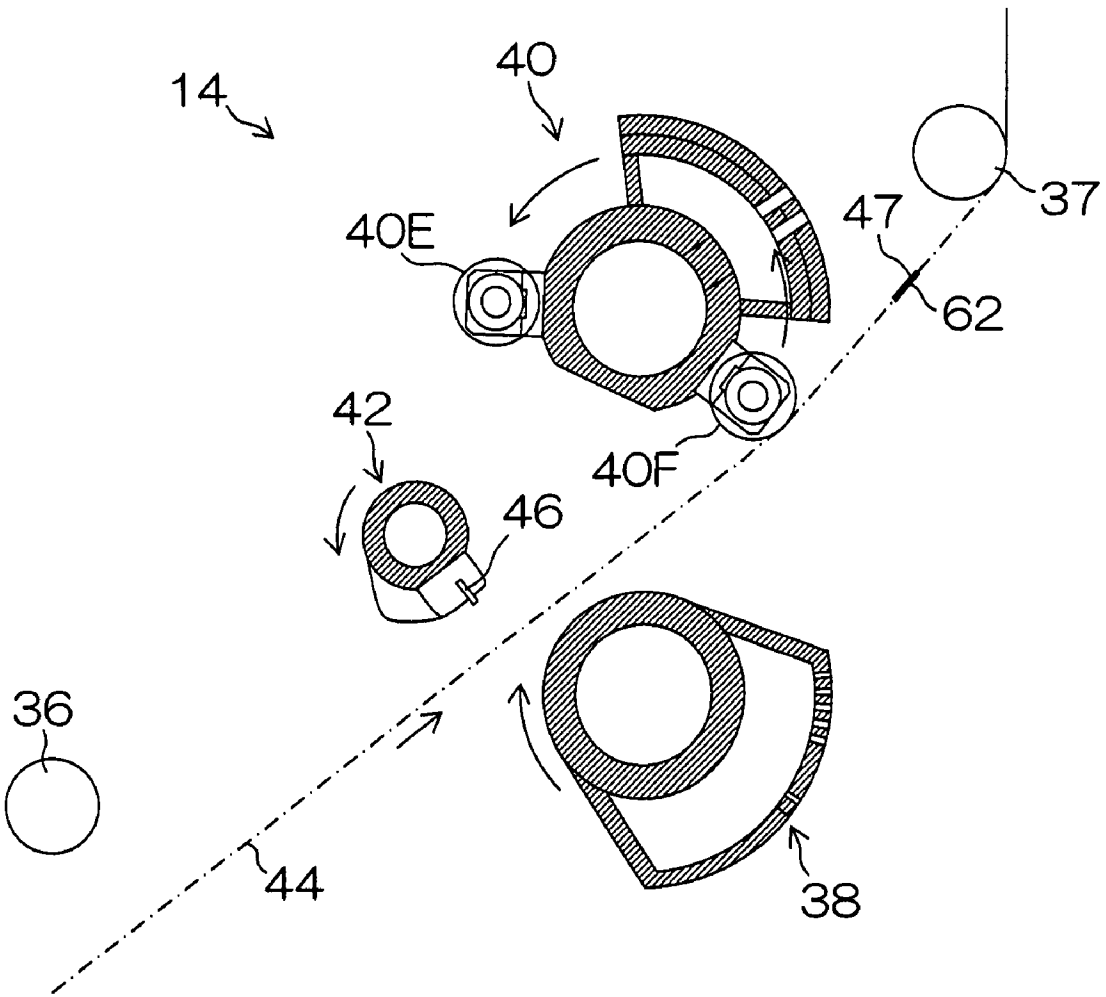
FIG. 9 is an operation explanatory diagram of the web joining unit.

When the respective drums 38, 40, 42 are further rotationally moved, the respective drums 38, 40, 42 are moved to the positions shown in FIG. 9, and the winding state of the web 44 on the circumferential surface of the back pasting drum 40 is released. However, since the upward left movement of the web 44 is restricted by the guide roller 40F of the back pasting drum 40, no such nonconformity occurs that the web 44 contacts the cutting drum 42.

When the respective drums 38, 40, 42 are further rotationally moved, the respective drums 38, 40, 42 are moved, and the winding state of the web 44 onto the guide roller 40F of the back pasting drum 40 is released. However, since the cutting drum 42 is rotationally moved in the direction where the cutter 46 of the cutting drum 42 gets away from the web 44, no such nonconformity occurs that the web 44 contacts the cutting drum 42. And the respective drums 38, 40, 42 are further rotationally moved, and the rotational movement is stopped in the initial state shown in FIG. 2.

According to the above described embodiment of the present invention, a guide member which guides so that the web does not deviate from the web conveying path at the joining is not needed, and no such nonconformity occurs that the guiding member rubs with the web to generate contamination such as dusts. Also, there is no such nonconformity that the guide member rubs with the web to generate a scratch on the web.

Also, since the upstream portion of the old web 32 (cutting chip 32A) is fed backward and discarded substantially at the same time as cutting-off of the old web 32, there is no such nonconformity that the old web 32 rubs with the new web 44 to generate contamination such as dusts.

Therefore, contamination such as dusts is not caused so as to be applied to a process requiring high cleanliness (degree of cleanness), the joining accuracy can be improved, and the web quality can be improved.

Figure 10B:
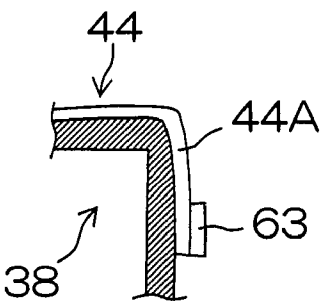
FIGS. 10A and 10B are operation explanatory diagrams of the web joining unit of another embodiment.
Figure 10A:
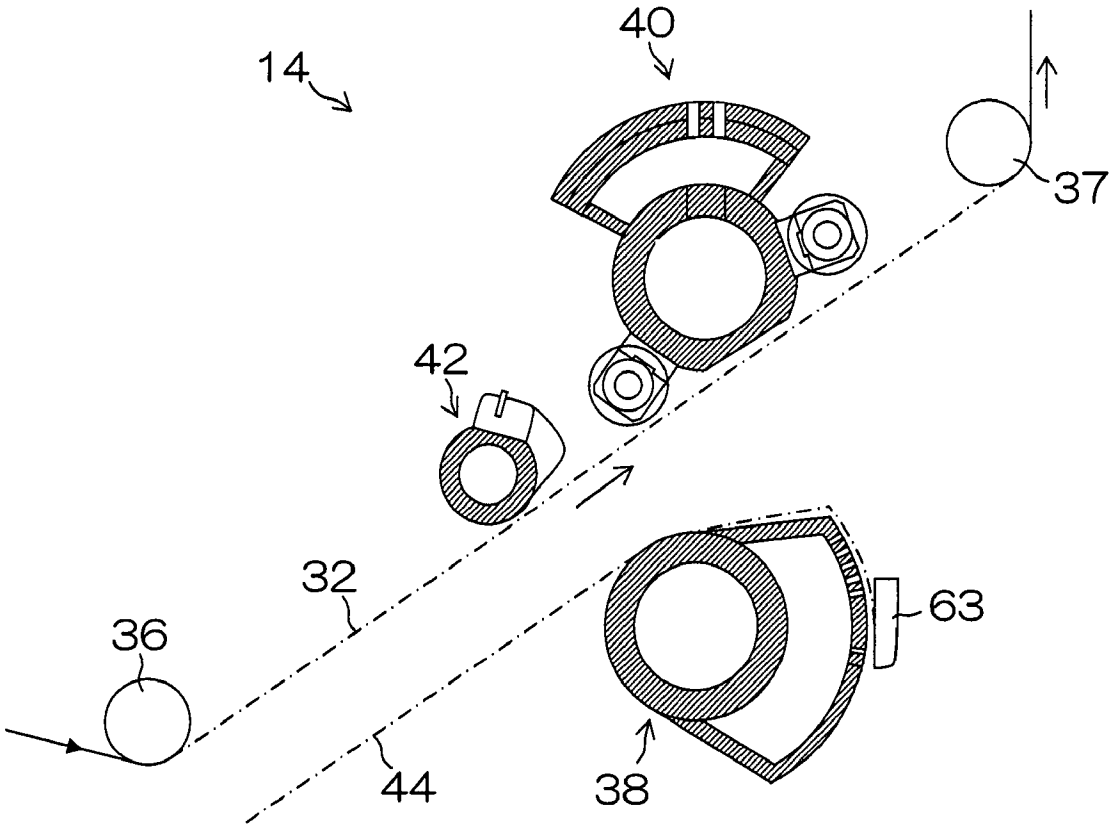

Next, another embodiment (second embodiment) of the present invention will be described referring to FIGS. 10 and 11. For the same or similar members as those in the first embodiment shown in FIGS. 1 to 9, the same reference numerals are given and their detailed description will be omitted.

In this embodiment, in place of the front pasting joining tape 62 in the first embodiment, a double-sided joining tape 63 is employed. FIG. 10 shows a state where the attracting plate 41 is moved as shown by the arrow 41A, the tip end 44A of the web 44 is supplied to the front pasting drum 38, and at the same time, the vent holes 50 (See FIG. 2) are made to communicate with the air intake device, not shown. By this, the web 44 to which the double-sided joining tape 63 is pasted at the tip end 44A is attracted and held as shown in the partial enlarged diagram in FIG. 10B, which corresponds to FIG. 3 of the first embodiment.

That is, as shown in FIG. 10B, the double-sided joining tape 63 is pasted on the back face of the tip end 44A of the web 44 by the double-sided tape supply device, not shown.

Figure 11B:
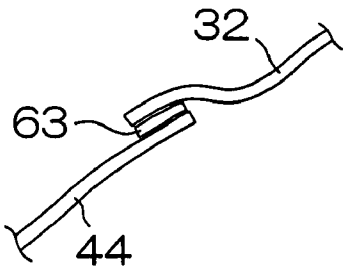
FIGS. 11A and 11B are operation explanatory diagrams of the web joining unit of another embodiment.
Figure 11A:
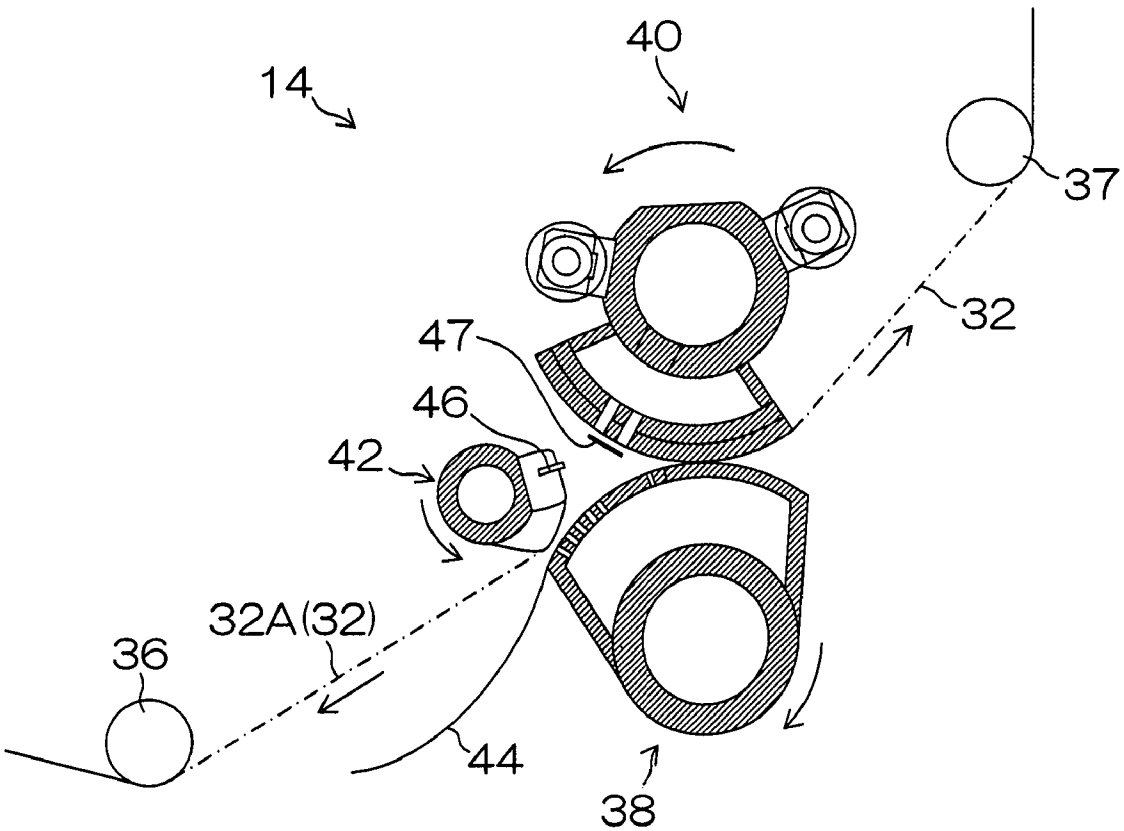

FIG. 11 shows a state where the double-sided joining tape 63 is pasted to the web 32, and from the state where the web 32 and the web 44 are in the overlapping joined state, the left portion of the cut-off web 32 (cutting chips 32A of the web 32) is rewound in the arrow direction and removed from the web joining unit 14, which corresponds to FIG. 7 of the first embodiment.

As shown in the partial enlarged diagram in FIG. 11B, the back face of the web 44 and the front face of the web 32 are joined to each other with the double-sided joining tape 63.

Moreover, the respective drums 38, 40, 42 are rotationally moved, and the back pasting joining tape 47 attracted and held by the attracting disk 40B of the back pasting drum 40 is pasted in the state extending over the overlapping joined part between the web 32 and the web 44.

In this state, the back face of the web 44 and the front face of the web 32 are in the joined state with the double-sided joining tape 63, and the back face of the web 44 and the back face of the web 32 are in the overlapping joined state with the back pasting joining tape 47.

According to the above described second embodiment of the present invention, the web 32 and the web 44 are joined together with the double-sided joining tape 63 in addition to the first embodiment, and the overlapping joining is further ensured.

Embodiments of the web joining device and the methods according to the present invention have been described above, but the present invention is not limited to the above embodiments but various modes can be employed.

For example, in this embodiment, the back face of the web 44 and the front face of the web 32 are joined by the double-sided joining tape 63, but in place of the construction of supplying the double-sided joining tape 63 to the back face of the web 44, a construction that an adhesive is applied on the back face of the web 44 can be employed, which gives substantially the same effects as those of this embodiment.

Also, the above embodiment is in the 3-drum construction of the front pasting drum 38, the back pasting drum 40 and the cutting drum 42, but as already mentioned, it may be the 2-drum construction without the back pasting drum 40, which gives substantially the same effects as those of this embodiment.

Moreover, the above embodiment is in the construction in which the shaft 26 and the shaft 30 of the turret device 12 are driven automatically, but instead of that, a manual type off-line setup station may be employed.

Furthermore, a nip device and the like may be arranged at the downstream side of the web joining device of the present invention as appropriate. By arranging such a nip device and the like, joining is further ensured.

What is claimed is:

1. A web joining apparatus, comprising:

a turret arm which supports an old roll and a new roll around which band-state flexible support bodies are wound capable of drawing and is rotatable per predetermined angle;

a front pasting drum provided with a holding device which holds the tip end of the band-state flexible support body of the new roll to which a double-sided joining tape is pasted on the back side of the tip end and capable of rotation at the same speed as the conveying speed of the band-state flexible support body at the joining of the band-state flexible support body; and a cutting drum provided with a cutting member with substantially the same length as the width of the band-state flexible support body, the cutting member being provided on circumferential surface and in which a projection amount from the circumferential surface is set so that only a single sheet of the band-state flexible support body can be cut off, and which cuts off only the band-state flexible support body of an old roll in a state where the band-state flexible support bodies of the old and a new rolls wound and held around the front pasting drum are overlapped with each other, the cutting drum being capable of rotation at the same speed as the conveying speed of the band-state flexible support body at the cutting of the band-state flexible support body, wherein the band-state flexible support body of the old roll is cut off and the tail end of the band-state flexible support body of the old roll and the tip end of the band-state flexible support body of the new roll are joined to each other while the band-state flexible support body is being conveyed.

2. The web joining apparatus according to claim 1, further comprising: a backward feeding device which withdraws the band-state flexible support body of the old roll in the direction opposite to the conveying direction so that the band-state flexible support body is withdrawn in the direction opposite to the conveying direction substantially at the same time as cutting-off of the band-state flexible support body of the old roll.

3. The web joining apparatus according to claim 2, further comprising: a double-sided tape supply device which pastes the double-sided joining tape on the back side of the tip end of the band-state flexible support body of the new roll.

4. A web joining apparatus, comprising:

a turret arm which supports an old roll and a new roll around which band-state flexible support bodies are wound capable of drawing and is rotatable per predetermined angle;

a front pasting drum provided with a holding device which holds the tip end of the band-state flexible support body of the new roll to which a front pasting joining tape is pasted on the front side of the tip end and capable of rotation at the same speed as the conveying speed of the band-state flexible support body at the joining of the band-state flexible support body;

a back pasting drum provided with a holding device which holds the back pasting joining tape capable of peeling and capable of rotation at the same speed as the conveying speed of the band-state flexible support body at the joining of the band-state flexible support body; and a cutting drum provided with a cutting member with substantially the same length as the width of the band-state flexible support body, the cutting member being provided on circumferential surface and in which a projection amount from the circumferential surface is set so that only a single sheet of the band-state flexible support body can be cut off, and which cuts off only the band-state flexible support body of an old roll in a state where the band-state flexible support bodies of the old and a new rolls wound and held around the front pasting drum are overlapped with each other, the cutting drum being capable of rotation at the same speed as the conveying speed of the band-state flexible support body at the cutting of the band-state flexible support body, wherein the band-state flexible support body of the old roll is cut off and the tail end of the band-state flexible support body of the old roll and the tip end of the band-state flexible support body of the new roll are joined to each other while the band-state flexible support body is being conveyed.

5. The web joining apparatus according to claim 4, further comprising: a backward feeding device which withdraws the band-state flexible support body of the old roll in the direction opposite to the conveying direction so that the band-state flexible support body is withdrawn in the direction opposite to the conveying direction substantially at the same time as cutting-off of the band-state flexible support body of the old roll.

6. The web joining apparatus according to claim 2, further comprising: a double-sided tape supply device which pastes the double-sided joining tape on the back side of the tip end of the band-state flexible support body of the new roll.

7. The web joining apparatus according to claim 4, further comprising: a double-sided tape supply device which pastes the double-sided joining tape on the back side of the tip end of the band-state flexible support body of the new roll.

8. A web joining method in which, while a band-state flexible support body wound around an old roll is made to run, the band-state flexible support body of the old roll is cut off and the vicinity of a tail end of the band-state flexible support body of the old roll and a tip end of a band-state flexible support body wound around a new roll are joined to each other, comprising the steps of:

holding the tip end of the band-state flexible support body of the new roll at a front side drum;

holding a back pasting joining tape at a back pasting drum;

overlapping the tail end of the band-state flexible support body of the old roll and the tip end of the band-state flexible support body of the new roll with each other while the front-side drum is rotated at the same speed as a conveying speed of the band-state flexible support body;

cutting off only the band-state flexible support body of the old roll after overlapping, at a position where the band-state flexible support bodies of the old and the new rolls are overlapped;

discarding an upstream portion in the conveying direction of the cut-off band-state flexible support body of the old roll; and joining through the back pasting joining tape a downstream portion in the conveying direction of the band-state flexible support body of the cut-off old roll to the tip end of the band-state flexible support body of the new roll while the back pasting drum is rotated at the same speed as the conveying speed of the band-state flexible support body.

9. A web joining method in which, while a band-state flexible support body wound around an old roll is made to run, the band-state flexible support body of the old roll is cut off and the vicinity of a tail end of the band-state flexible support body of the old roll and a tip end of a band-state flexible support body wound around a new roll are joined to each other, comprising the steps of:

holding at the front pasting drum the tip end of the band-state flexible support body of the new roll to which a front pasting joining tape is pasted on the front side of the tip end;

joining the tail end of the band-state flexible support body of the old roll and the tip end of the band-state flexible support body of the new roll to each other through the front pasting joining tape while the front pasting drum is rotated at the same speed as the conveying speed of the band-state flexible support body;

cutting off only the band-state flexible support body of the old roll after joining, at a position where the band-state flexible support bodies of the old and the new rolls are overlapped; and discarding an upstream portion in the conveying direction of the cut-off band-state flexible support body of the old roll.

10. A web joining method in which, while a band-state flexible support body wound around an old roll is made to run, the band-state flexible support body of the old roll is cut off and the vicinity of a tail end of the band-state flexible support body of the old roll and a tip end of a band-state flexible support body wound around a new roll are joined to each other, comprising the steps of:

holding at the front pasting drum the tip end of the band-state flexible support body of the new roll to which a double-sided joining tape is pasted on the back side of the tip end;

joining the tail end of the band-state flexible support body of the old roll and the tip end of the band-state flexible support body of the new roll to each other through the double-sided joining tape while the front pasting drum is rotated at the same speed as the conveying speed of the band-state flexible support body;

cutting off the band-state flexible support body of the old roll after joining; and discarding an upstream portion in the conveying direction of the cut-off band-state flexible support body of the old roll.

11. A web joining method in which, while a band-state flexible support body wound around an old roll is made to run, the band-state flexible support body of the old roll is cut off and the vicinity of a tail end of the band-state flexible support body of the old roll and a tip end of a band-state flexible support body wound around a new roll are joined to each other, comprising the steps of:

holding at the front pasting drum the tip end of the band-state flexible support body of the new roll to which a front pasting joining tape is pasted on the front side of the tip end;

holding a back pasting joining tape at a back pasting drum;

joining the tail end of the band-state flexible support body of the old roll and the tip end of the band-state flexible support body of the new roll to each other through the front pasting joining tape while the front pasting drum is rotated at the same speed as the conveying speed of the band-state flexible support body;

cutting off only the band-state flexible support body of the old roll after joining, at a position where the band-state flexible support bodies of the old and the new rolls are overlapped;

discarding an upstream portion in the conveying direction of the cut-off band-state flexible support body of the old roll; and joining a downstream portion in the conveying direction of the cut-off band-state flexible support body of the old roll and the tip end of the band-state flexible support body of the new roll to each other through the back pasting joining tape while the back pasting drum is rotated at the same speed as the conveying speed of the band-state flexible support body.

12. The web joining method according to claim 11, further comprising the steps of:

pasting a double-sided joining tape on the back side of the tip end of the band-state flexible support body of the new roll; and joining the vicinity of the tail end of the band-state flexible support body of the old roll and the tip end of the band-state flexible support body of the new roll to each other through the double-sided joining tape at joining of the vicinity of the tail end of the band-state flexible support body of the old roll and the tip end of the band-state flexible support body of the new roll to each other through the front pasting joining tape.

* * * * *